US006341647B1

(12) United States Patent
Nobuta et al.

(10) Patent No.: US 6,341,647 B1
(45) Date of Patent: Jan. 29, 2002

(54) SEPARATOR-INTEGRATED CONDENSER FOR VEHICLE AIR CONDITIONER

(75) Inventors: Tetsuji Nobuta; Hiroki Matsuo, both of Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/496,861

(22) Filed: Feb. 2, 2000

(30) Foreign Application Priority Data

Feb. 3, 1999 (JP) ..... 11-026427

(51) Int. Cl.[7] ..... F28D 1/06
(52) U.S. Cl. ..... 165/132; 62/509
(58) Field of Search ..... 165/132, 110, 165/DIG. 342; 62/509, 503, 512

(56) References Cited

U.S. PATENT DOCUMENTS 5,379,833 A * 1/1995 Mathews ..... 165/132
5,537,839 A * 7/1996 Burk et al. ..... 165/132
5,713,217 A * 2/1998 Baba ..... 62/509
5,813,249 A * 9/1998 Matsuo et al. ..... 62/509
5,934,102 A * 8/1999 DeKeuster et al. ..... 62/509
5,937,671 A * 8/1999 Inoue et al. ..... 62/509
5,946,938 A * 9/1999 Balthazard ..... 62/509
5,946,940 A * 9/1999 Inoue ..... 62/509
6,000,465 A * 12/1999 Kawahara ..... 165/132

FOREIGN PATENT DOCUMENTS

JP A-7-103612 4/1995
JP A-7-180930 7/1995

* cited by examiner

*Primary Examiner*—Ira S. Lazarus
*Assistant Examiner*—Terrell McKinnon
(74) *Attorney, Agent, or Firm*—Harness, Dickey & Pierce, PLC

(57) ABSTRACT

A separator-integrated condenser includes a core portion, a header tank and a separating unit integrally formed with the header tank for separating gas-liquid two-phase refrigerant into gas refrigerant and liquid refrigerant and storing the liquid refrigerant therein. An inlet through which refrigerant in the header tank is introduced into the separating unit is disposed at one longitudinal end of the separating unit, and an outlet through which refrigerant is discharged from the separating unit is disposed at the other longitudinal end of the separating unit. When the condenser is mounted to be inclined at up to 45 degrees with respect to a horizontal direction in a longitudinal direction of the header tank and the separating unit, the inlet is disposed at an upper side of the outlet. As a result, gas-liquid two-phase refrigerant is sufficiently separated by the separating unit.

15 Claims, 7 Drawing Sheets

SEPARATOR-INTEGRATED CONDENSER FOR VEHICLE AIR CONDITIONER

CROSS REFERENCE TO RELATED APPLICATIONS

This application relates to and claims priority from Japanese Patent Application No. 11-26427 filed on Feb. 3, 1999, the contents of which are hereby incorporated by reference.

BACKGROUND OF THE INVENTION

1. Field of the Invention

The present invention relates generally to condensers, and particularly to a separator-integrated condenser for a vehicle air conditioner including a separating unit which separates gas-liquid two-phase refrigerant into gas refrigerant and liquid refrigerant and stores liquid refrigerant therein.

2. Related Art

JP-A-7-180930 discloses a separator-integrated condenser for a vehicle air conditioner which includes a separating unit to reduce a mounting space thereof in a vehicle in comparison with that of the condenser and the separating unit separately mounted. The separating unit is formed into a tank shape, and is disposed to extend in a top-bottom direction of the vehicle (i.e., in a direction of gravity) for separating gas-liquid two-phase refrigerant into gas refrigerant and liquid refrigerant by a density difference between gas refrigerant and liquid refrigerant. A sectional area of the separating unit is set relatively small to further reduce a mounting space of the separator-integrated condenser. The separating unit has an inlet through which refrigerant flows into the separating unit and an outlet through which refrigerant is discharged from the separating unit. The inlet is formed to be disposed below a surface of liquid refrigerant in the separating unit when the separating unit is operated under a normal condition. The outlet is formed below the inlet in the separating unit. As a result, refrigerant from the inlet is introduced directly into a lower part of liquid refrigerant stored in the separating unit, and the surface of liquid refrigerant in the separating unit is restricted from being disturbed by dynamic pressure of entering refrigerant. Therefore, gas refrigerant is restricted from being discharged from the outlet, and gas-liquid two-phase refrigerant is sufficiently separated into gas refrigerant and liquid refrigerant even when the sectional area of the separating unit is relatively small.

However, in a vehicle such as a cabover truck or an one-box car in which an engine is disposed in a lower part of a passenger compartment, the above-mentioned separator-integrated condenser needs to be disposed in a substantially horizontal direction. As a result, since the inlet and the outlet are disposed relatively adjacent to each other, gas refrigerant may be discharged from the outlet without being separated from gas-liquid two-phase refrigerant by the separating unit. Even when the separator-integrated condenser is disposed to be inclined at up to 45 degrees with respect to a horizontal direction, gas refrigerant may be also discharged from the outlet.

SUMMARY OF THE INVENTION

In view of the foregoing problems, it is an object of the present invention to provide a separator-integrated condenser including a separating unit in which gas-liquid two-phase refrigerant is sufficiently separated into gas refrigerant and liquid refrigerant even when the condenser is mounted in a substantially horizontal direction or mounted to be inclined at a predetermined angle with respect to a horizontal direction.

According to the present invention, a separator-integrated condenser includes a condensing unit having a core portion for condensing refrigerant and a header tank into which the refrigerant condensed by the core portion is collected, and a separating unit for separating the refrigerant into gas refrigerant and liquid refrigerant. The separating unit is integrally formed with the header tank so that a longitudinal direction of the separating unit coincides with a longitudinal direction of the header tank. The separating unit includes an inlet through which the refrigerant in the header tank is introduced into the separating unit, and an outlet through which the refrigerant is discharged from the separating unit. The inlet is formed at a first longitudinal end of the separating unit, and the outlet is formed at a second longitudinal end of the separating unit. The header tank and the separating unit are inclined at a predetermined angle with respect to a horizontal direction in the longitudinal directions thereof, so that the first longitudinal end of the separating unit is disposed at an upper side of the second longitudinal end of the separating unit.

As a result, the inlet is disposed at an upper side of the outlet, and is sufficiently away from the outlet. Therefore, the refrigerant introduced from the inlet is sufficiently separated into gas refrigerant and liquid refrigerant due to gravity while flowing through the separating unit toward the outlet, and the outlet is constantly immersed in the liquid refrigerant stored in the separating unit. As a result, the gas refrigerant is restricted from being discharged from the outlet.

When the separating unit is disposed in a substantially horizontal direction, the inlet is formed at an upper side of the outlet in the separating unit. As a result, refrigerant is sufficiently separated into gas refrigerant and liquid refrigerant while flowing a sufficiently long flow path between the inlet and the outlet, and gas refrigerant is restricted from being discharged from the outlet. Thus, even when the separator-integrated condenser including the separation unit is mounted in a substantially horizontal direction or mounted to be inclined at a predetermined angle, refrigerant is sufficiently separated into gas refrigerant and liquid refrigerant by the separating unit.

BRIEF DESCRIPTION OF THE DRAWINGS

This and other objects and features of the present invention will become more readily apparent from a better understanding of the preferred embodiments described below with reference to the accompanying drawings, in which.

DETAILED DESCRIPTION OF THE PREFERRED EMBODIMENTS

Preferred embodiments of the present invention are described hereinafter with reference to the accompanying drawings.

Figure 1:
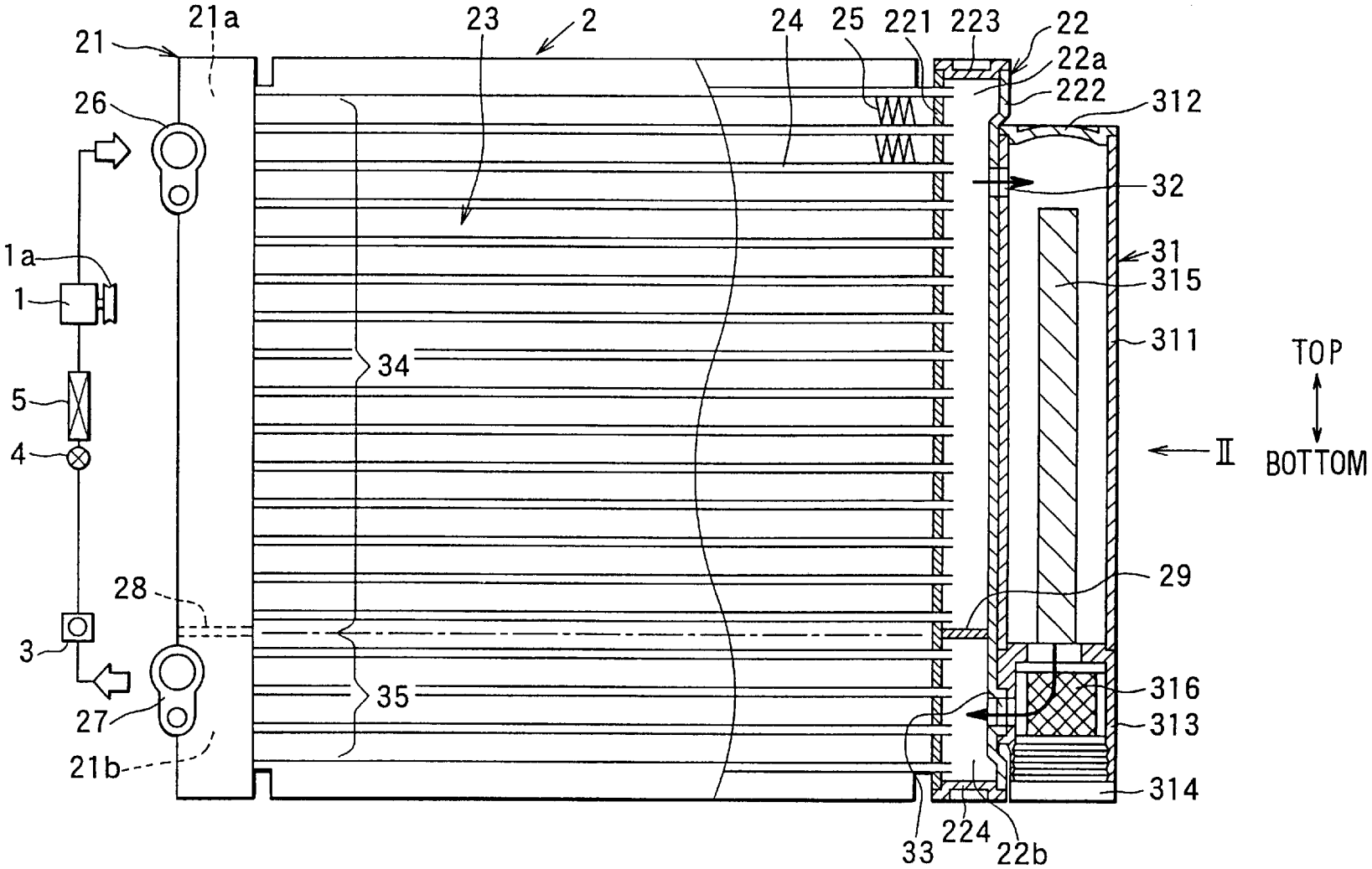
FIG. 1 is a partially-sectional front view showing a separator-integrated condenser for a vehicle air conditioner according to a first preferred embodiment of the present invention.

A first preferred embodiment of the present invention will be described with reference to FIGS. 1–3. In the first embodiment, as shown in FIG. 1, a refrigeration cycle of a vehicle air conditioner includes a compressor 1, a separator-integrated condenser 2 (hereinafter referred to as the condenser 2) including a separating unit 31 , a sight glass 3 through which an amount of refrigerant circulating through the cycle is checked, a temperature-actuated expansion valve 4 and an evaporator 5. The units 1–5 are connected to each other in this order by metal or rubber pipes to form a closed circuit.

The compressor 1 is connected to a vehicle engine (not shown) disposed in an engine compartment of a vehicle through a belt and an electromagnetic clutch 1*a*. When an engagement of the electromagnetic clutch 1*a* is achieved, rotational power of the engine is transmitted to the compressor 1, and the compressor 1 sucks gas refrigerant from an outlet of the evaporator 5. The compressor 1 compresses the gas refrigerant, and discharges high-temperature high-pressure superheated gas refrigerant toward the condenser 2.

The condenser 2 includes first and second header tanks 21, 22 disposed with a predetermined interval therebetween, and a core portion 23 disposed between the first and second header tanks 21, 22 for performing heat-exchange. Each of the first and second header tanks 21, 22 is formed into a substantially cylindrical shape, and extends in a top-bottom direction in FIG. 1. The condenser 2 is a so-called multi-flow type. The heater core 23 includes plural flat tubes 24 through which refrigerant flows in a horizontal direction, and plural corrugated fins 25 disposed between adjacent tubes 24 and connected to the tubes 24. One flow-path end of each tube 24 communicates with the first header tank 21, and the other flow-path end of each tube 24 communicates with the second header tank 22.

Still referring to FIG. 1, an inlet joint 26 is attached to one longitudinal end of the first header tank 21, and an outlet joint 27 is attached to the other longitudinal end of the first header tank 21. Refrigerant is introduced into the first header tank 21 through the inlet joint 26, and is discharged from the first header tank 21 through the outlet joint 27. The first header tank 21 is partitioned in a longitudinal direction thereof (i.e., in the top-bottom direction in FIG. 1) by a partition member 28 into tank portions 21*a*, 21*b*. Similarly, the second header tank 22 is partitioned in a longitudinal direction thereof by a partition member 29 into tank portions 22*a*, 22*b*. The partition member 28 is disposed adjacent to the outlet joint 27. The partition member 29 is disposed at a substantially same height as the partition member 28.

The second header tank 22 is integrally connected to the separating unit 31 which separates gas-liquid two-phase refrigerant into gas refrigerant and liquid refrigerant and stores liquid refrigerant therein. The separating unit 31 is formed into a substantially cylindrical shape, and is disposed at a side of the second header tank 22 opposite to the core portion 23 to be integrally connected to an outer surface of the second header tank 22. A height of the separating unit 31 is slightly smaller than that of the second header tank 22. In the first embodiment, the parts of the condenser 2 are made of aluminum, and are integrally brazed together.

The first and second header tanks 21, 22 have a substantially same structure. As shown in FIG. 1, the second header tank 22 is formed by a first plate 221 and a second plate 222 each of which has a substantially semicircular cross-section. One flow-path end of each tube 24 is connected to the first plate 221 and is held by the first plate 221. The second header tank 22 is formed by connecting the first plate 221 and the second plate 222 to have a substantially cylindrical shape. Upper and lower ends of the second header tank 22 are respectively closed by caps 223, 224.

The separating unit 31 includes a substantially cylindrical body portion 311. One longitudinal end of the body portion 311 is closed by a cap 312. The second plate 222 and the body portion 311 respectively have a flat portion, and are brazed to each other while the flat portion of the second plate 222 contacts the flat portion of the body portion 311. A substantially-cylindrical base portion 313 is connected to the other longitudinal end of the body portion 311, and is closed by a cap 314. The cap 314 is screwed into the base portion 313 detachably and hermetically through a sealing member (not shown). A drying agent 315 for absorbing moisture and a filter 316 for removing foreign matters from refrigerant are disposed on and connected to an upper end of the base portion 313. The filter 316 is made of a cylindrical shaped net.

In the first embodiment, the present invention is applied to an air conditioner for a vehicle such as a cabover truck or one-box car in which the engine is disposed in a lower part of the passenger compartment. Therefore, as shown in FIG. 2, the condenser 2 is mounted to be inclined at a relatively small predetermined inclination angle $\theta$ with respect to a horizontal direction due to a limited mounting space of the condenser 2. In the first embodiment, the inclination angle $\theta$ is set to 45 degrees or less. The condenser 2 is disposed at an upstream air side of a radiator (not shown) of the engine, and performs heat exchange between refrigerant flowing through the condenser 2 and air blown by an electrical cooling fan (not shown). Further, the condenser 2 is mounted in a lower part of the passenger compartment in such a manner that a longitudinal direction of the second header tank 22 coincides with a longitudinal direction of the separating unit 31, and the second header tank 22 and the separating unit 31 are inclined at the inclination angle $\theta$ in the longitudinal directions thereof.

Refrigerant condensed by the core portion 23 becomes saturated gas-liquid two-phase refrigerant, and is collected into the tank portion 22*a* of the second header tank 22. An inlet 32 is formed between the second header tank 22 and the separating unit 31 so that refrigerant in the tank portion 22*a* is introduced into the separating unit 31 through the inlet 32. An outlet 33 is formed between the second header tank 22 and the separating unit 31 so that refrigerant in the separating unit 31 is discharged toward the tank portion 22*b* through the outlet 33. As shown in FIG. 2, the inlet 32 is formed at one longitudinal end of the separating unit 31, and the outlet 33 is formed at the other longitudinal end of the separating unit 31. The one longitudinal end of the separating unit 31 is disposed at an upper side of the other longitudinal end of the separating unit 31 when the condenser 2 is inclined at the inclination angle θ. Therefore, the inlet 32 is disposed at an upper side of the outlet 33 when the condenser 2 is inclined at the inclination angle θ. Thus, although both the inlet 32 and the outlet 33 are formed on a center line 31*b* of the separating unit 31, the outlet 33 is positioned at a lower side of the inlet 32 in a direction of gravity when the condenser 2 is inclined at the inclination angle θ. Further, the inlet 32 and the outlet 33 are positioned sufficiently away from each other with a relatively large distance therebetween in the longitudinal direction of the separating unit 31.

The inlet 32 is formed by boring the second plate 222 of the second header tank 22 and the body portion 311 of the separating unit 31. The outlet 33 is formed by boring the second plate 222 and the base portion 313. In the first embodiment, the separating unit 31 is formed into a pipe shape having a relatively small inner diameter of approximately 30 mm. In FIG. 2, a broken line shows a surface 31*a* of liquid refrigerant stored in the separating unit 31 when the refrigeration cycle is operated under a normal condition.

Referring back to FIG. 1, the core portion 23 includes a condensing portion 34 disposed above the partition members 28, 29, and a supercooling portion 35 disposed below the partition members 28, 29. The condensing portion 34 cools and condenses gas refrigerant discharged from the compressor 1 through heat exchange between the gas refrigerant and air from outside the passenger compartment blown by the cooling fan. The supercooling portion 35 supercools liquid refrigerant separated by the separating unit 31 through heat exchange between the liquid refrigerant and air from outside the passenger compartment. Thus, the condenser 2 includes the condensing portion 34, the separating unit 31 and the supercooling portion 35 connected to each other, and refrigerant flows through the condensing portion 34, the separating unit 31 and the supercooling portion 35 in this order.

Next, an operation of the refrigeration cycle according to the first embodiment will be described. When the air conditioner is turned on, and the engagement of the electromagnetic clutch 1*a* is achieved, rotational power of the engine is transmitted to the compressor 1, and the compressor 1 compresses refrigerant and discharges superheated gas refrigerant. Then, the superheated gas refrigerant is introduced into the tank portion 21*a* of the first header tank 21 of the condenser 2 from the inlet joint 26. The gas refrigerant flows through the tubes 24 of the condensing portion 34 from right to left in FIG. 1, and flows into the tank portion 22*a* of the second header tank 22. While the gas refrigerant flows through the tubes 24 of the condensing portion 34, the gas refrigerant is heat-exchanged with cool air passing through the condensing portion 34 through the tubes 24 and the fins 25. As a result, the gas refrigerant is cooled and becomes saturated gas-liquid two-phase refrigerant. The saturated gas-liquid two-phase refrigerant in the tank portion. 22*a* is introduced into the separating unit 31 through the inlet 32, and is separated into liquid refrigerant and gas refrigerant by the separating unit 31. The liquid refrigerant is stored in the separating unit 31.

Figure 2:
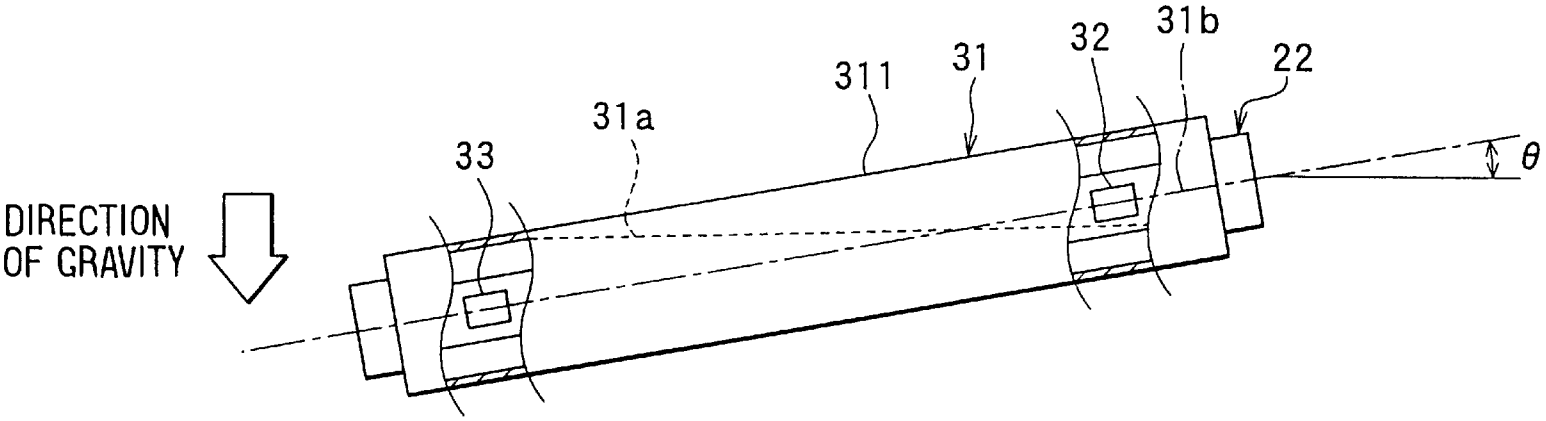
FIG. 2 is a partially-sectional side view taken from arrow II in FIG. 1.

According to the first embodiment, as shown in FIG. 2, the condenser 2 is inclined at the inclination angle θ with respect to the horizontal direction in the longitudinal direction of the second header tank 22 and the separating unit 31. The inlet 32 is formed at the one longitudinal end of the separating unit 31, and the outlet 33 is formed at the other longitudinal end of the separating unit 31 disposed at a lower side of the one longitudinal end of the separating unit 31. Therefore, the outlet 33 is disposed at a lower side of the inlet 32 in the direction of gravity, and the distance between the inlet 32 and the outlet 33 is relatively large. As a result, a length of a flow path of refrigerant between the inlet 32 and the outlet 33 is sufficiently increased as long as a whole longitudinal length of the separating unit 31. Therefore, the saturated gas-liquid two-phase refrigerant is sufficiently separated into gas refrigerant and liquid refrigerant while flowing the relatively long flow path, and liquid refrigerant is accumulated in a lower portion of the separating unit 31 by density difference between gas refrigerant and liquid refrigerant.

Further, as shown in FIG. 2, the surface 31*a* of the liquid refrigerant in the separating unit 31 is above the outlet 33 when the condenser 2 is operated under a normal condition. The surface 31*a* of the liquid refrigerant widely extends in the longitudinal direction of the separating unit 31, and refrigerant from the inlet 32 is introduced into the separating unit 31 at a position sufficiently away from the outlet 33. Therefore, dynamic pressure of the introduced refrigerant only disturbs the surface 31*a* adjacent to the inlet 32, and hardly disturbs the surface 31*a* adjacent to the outlet 33. As a result, gas refrigerant is restricted from being discharged from the outlet 33, and only liquid refrigerant is discharged from the outlet 33 toward the tank portion 22*b* of the second header tank 22. Thus, according to the first embodiment, even when the condenser 2 is mounted to be inclined at the inclination angle θ, the refrigerant is sufficiently separated into gas refrigerant and liquid refrigerant by the separating unit 31.

The liquid refrigerant in the tank portion 22*b* flows into the supercooling portion 35 to be supercooled. The supercooled refrigerant flows into the tank portion 21*b* through the tubes 24, and is discharged from the condenser 2 through the outlet joint 27. Then, the supercooled refrigerant flows into the expansion valve 4 through the sight glass 3 to be decompressed by the expansion valve 4 and become low-temperature, low-pressure gas-liquid two-phase refrigerant. The gas-liquid two-phase refrigerant is evaporated by the evaporator 5 through heat exchange with air to be conditioned. When the refrigerant is evaporated, the refrigerant absorbs heat from air so that air is cooled. Superheated gas refrigerant evaporated by the evaporator 5 is sucked into the compressor 1 to be compressed again.

Figure 3:
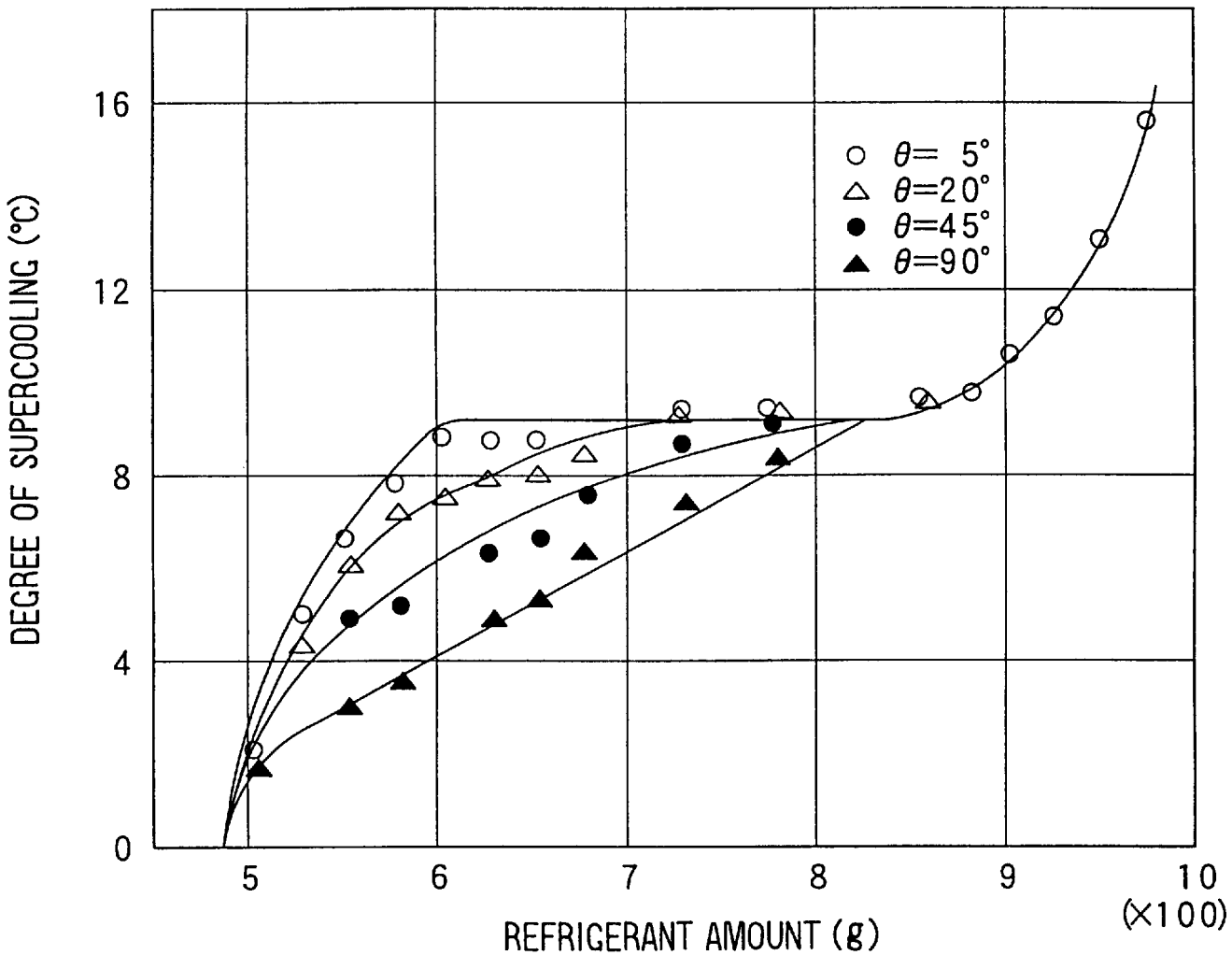
FIG. 3 is a graph showing a relationship between an amount of refrigerant circulating through a refrigeration cycle and a degree of supercooling of refrigerant for various inclination angle θ of the condenser according to the first embodiment.

Referring to FIG. 3, an experiment was conducted to investigate a relationship between an amount of refrigerant circulating the refrigeration cycle and a degree of supercooling of refrigerant discharged from the supercooling portion 35. The experiment was conducted for each inclination angle θ of 5, 20, 45 and 90 degrees. In the experiment, the inner diameter of the separating unit 31 was approximately 30 mm. The results are shown in FIG. 3.

In FIG. 3, when the inclination angle θ is 90 degrees, the separating unit 31 is disposed in a vertical direction, that is, in the direction of gravity. In this case, dynamic pressure of refrigerant from the inlet 32 is applied to a relatively small area of the surface 31*a* of the liquid refrigerant in the separating unit 31. As a result, the surface 31*a* of the liquid refrigerant is largely disturbed. Especially, since the separating unit 31 has a relatively small inner diameter of 30 mm, the surface 31*a* of the liquid refrigerant is relatively largely disturbed. As a result, the surface 31*a* of the liquid refrigerant in the separating unit 31 becomes unstable, and gas refrigerant may be discharged from the outlet 33. Therefore, even when the amount of refrigerant circulating the refrigeration cycle is increased, an increase in the degree of supercooling of refrigerant is relatively small. As a result, an improvement of cooling performance of the evaporator 5 is also relatively small.

On the other hand, when the inclination angle θ of the separating unit 31 is 5, 20 or 45 degrees, the degree of supercooling of refrigerant is largely increased as the amount of refrigerant circulating through the refrigeration cycle is increased. This shows that when the condenser 2 is inclined at the inclination angle θ of 5, 20 or 45 degrees, gas-liquid two-phase refrigerant is sufficiently separated into gas refrigerant and liquid refrigerant by the separating unit 31. Thus, according to the first embodiment, even when the separating unit 31 has a relatively small inner diameter of 30 mm, and is disposed to be inclined at a relatively small angle such as 45 degrees or less, the separating unit 31 sufficiently separates gas-liquid two-phase refrigerant into gas refrigerant and liquid refrigerant.

A second preferred embodiment of the present invention will be described with reference to FIG. 4. In this and following embodiments, components which are substantially the same as those in previous embodiments are assigned the same reference numerals.

Figure 4:
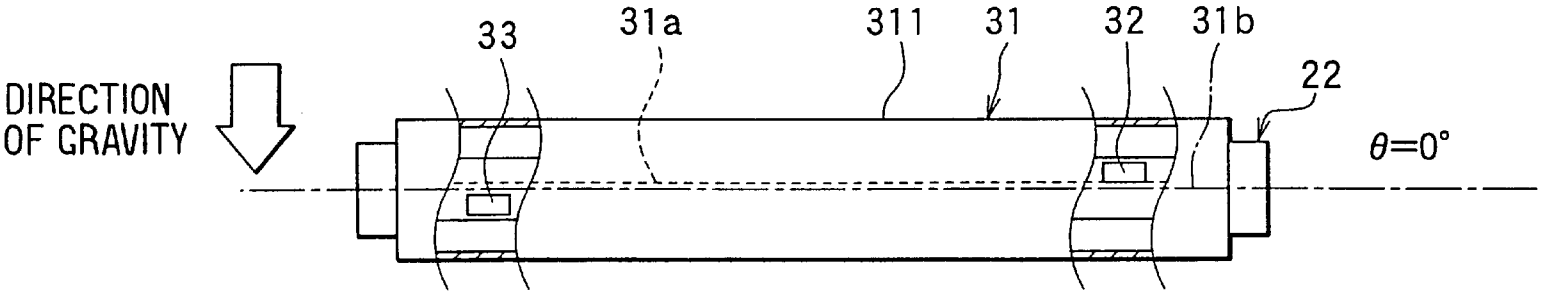
FIG. 4 is a partially-sectional side view showing a separator-integrated condenser for a vehicle air conditioner according to a second preferred embodiment of the present invention.

As shown in FIG. 4, in the second embodiment, the condenser 2 is mounted on a vehicle so that the second header tank 22 and the separating unit 31 are disposed in a substantially horizontal direction. That is, in the second embodiment, the inclination angle θ is approximately 0. Further, each inlet 32 and outlet 33 is formed into a rectangular shape extending in the substantially horizontal direction. The inlet 32 is formed above the center line 31*b* and the outlet 33 is formed below the center line 31*b* in the direction of gravity.

According to the second embodiment, when the refrigeration cycle is operated under a normal condition, the surface 31*a* of liquid refrigerant in the separating unit 31 is formed between the inlet 32 and the outlet 33 in the direction of gravity. Therefore, even when the condenser 2 is disposed in the substantially horizontal direction, the gas-liquid two-phase refrigerant is sufficiently separated by the separating unit 31 into gas refrigerant and liquid refrigerant.

A third preferred embodiment of the present invention will be described with reference to FIG. 5. In the third embodiment, the present invention is applied to the condenser 2 in which refrigerant flows through an N-shaped flow path in the condensing portion 34.

Figure 5:
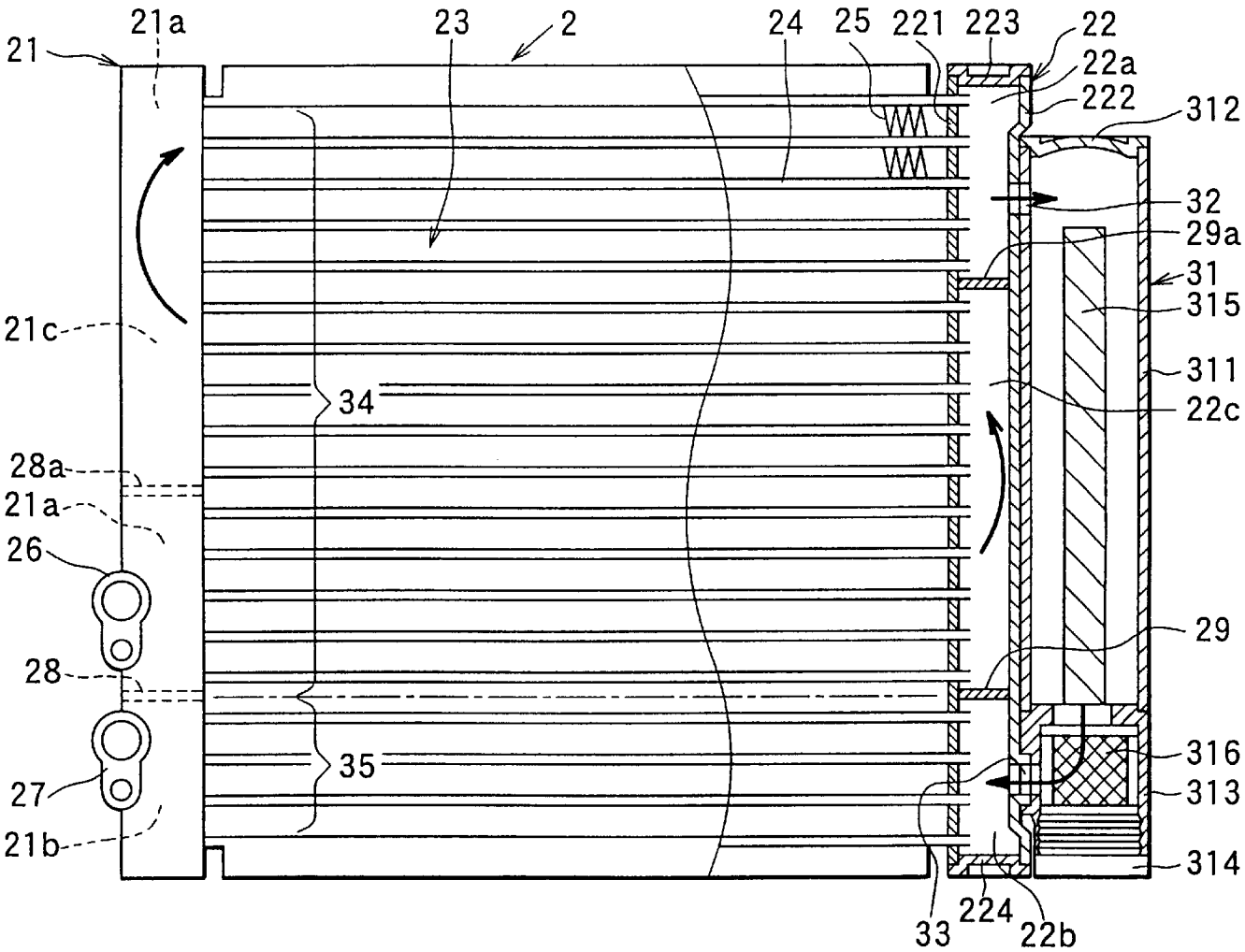
FIG. 5 is a partially-sectional front view showing a separator-integrated condenser for a vehicle air conditioner according to a third preferred embodiment of the present invention.

In the third embodiment, the inlet joint 26 is disposed immediately above the partition member 28 in FIG. 5 in a center part of the first header tank 21 in the longitudinal direction thereof. Further, a partition member 28*a* is additionally disposed in the first header tank 21 above the inlet joint 26 in FIG. 5, so that the first header tank 21 is partitioned into the three tank portions 21*a*, 21*b* and 21*c* in the longitudinal direction thereof. On the other hand, a partition member 29*a* is additionally disposed in the second header tank 22 above the partition member 28*a* in FIG. 5, so that the second header tank 22 is partitioned into the three tank portions 22*a*, 22*b* and 22*c* in the longitudinal direction thereof.

According to the third embodiment, refrigerant introduced from the inlet joint 26 into the tank portion 21*a* flows into the tank portion 22*c*, the tank portion 21*c*, and the tank portion 22*a* in this order through the tubes 24. That is, refrigerant flows through an N-shaped flow path in the condensing portion 34 in a direction indicated by arrows in FIG. 5. In the third embodiment, the same effect as in the first and second embodiments is obtained.

A fourth preferred embodiment of the present invention will be described with reference to FIGS. 6–8. In the fourth embodiment, separation performance of gas-liquid two-phase refrigerant by the separating unit 31 is improved using not only gravity but also centrifugal force.

Figure 6:
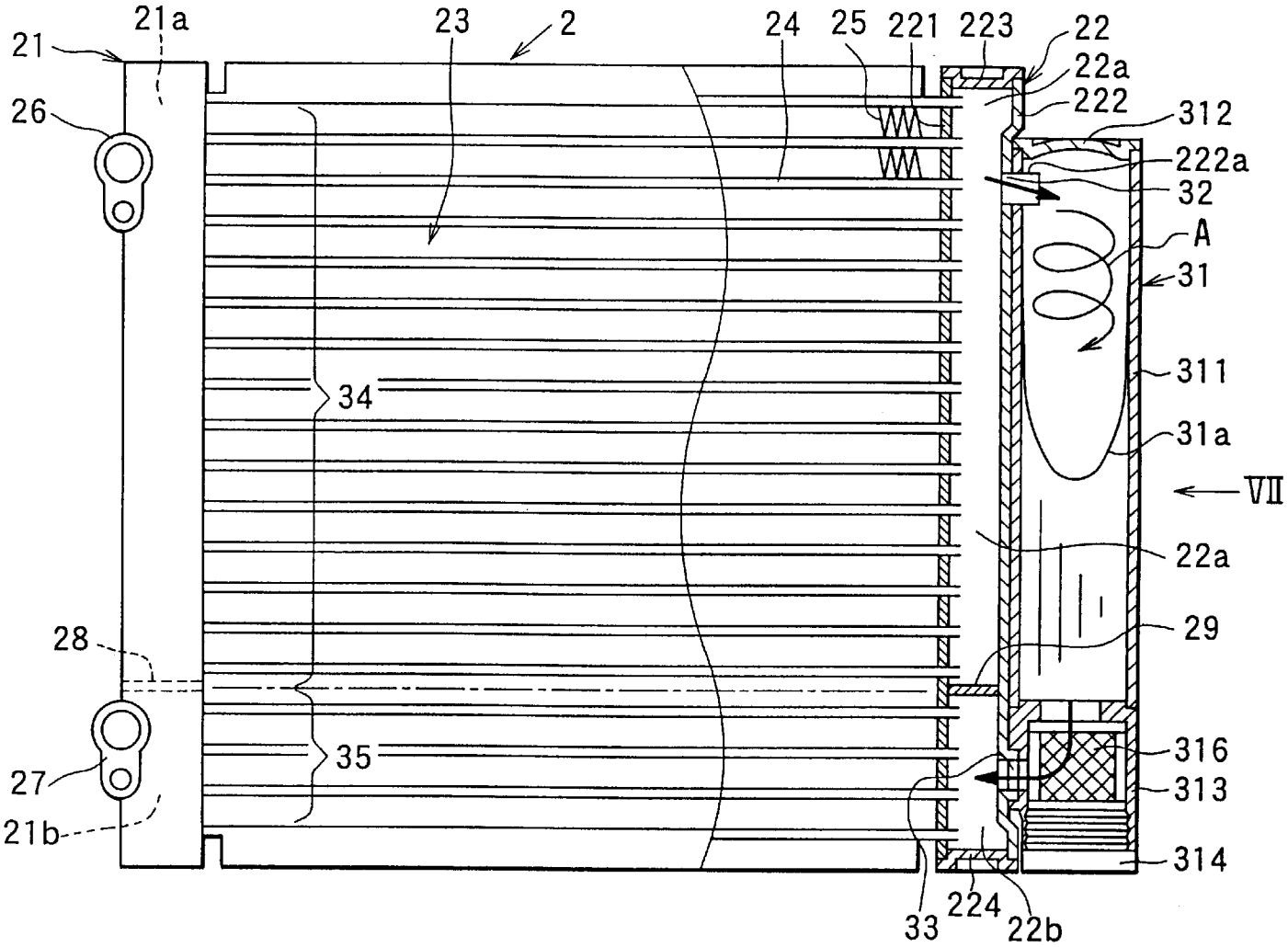
FIG. 6 is a partially-sectional front view showing a separator-integrated condenser for a vehicle air conditioner according to a fourth preferred embodiment of the present invention.

In the fourth embodiment, as shown in FIG. 6, a guide portion 222*a* is integrally formed with the second plate 222 of the second header tank 22 in the vicinity of the inlet 32. As shown in FIGS. 7 and 8, the guide portion 222*a* extends from a lower side of the inlet 32 in the direction of gravity to protrude inside the separating unit 31. In the separating unit 31, the guide portion 222*a* is curved upwardly along the inlet 32. Therefore, refrigerant introduced into the separating unit 31 from the inlet 32 is guided by the guide portion 222*a* to flow along an inner wall of the body portion 311 of the separating unit 31 in a circumferential direction thereof.

Figure 7:
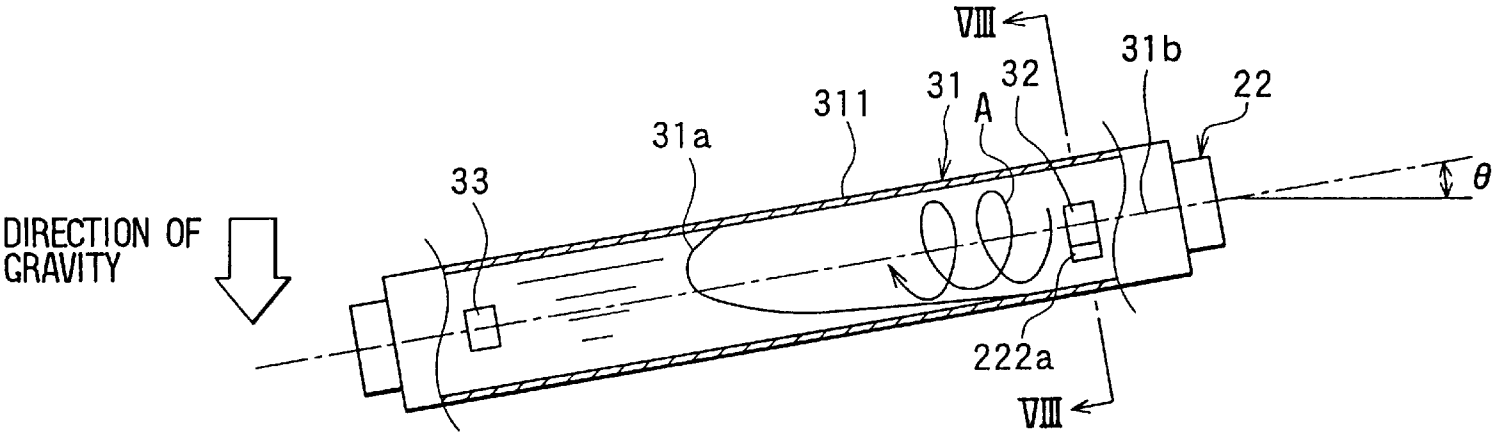
FIG. 7 is a partially-sectional side view taken from arrow VII in FIG. 6.
Figure 8:
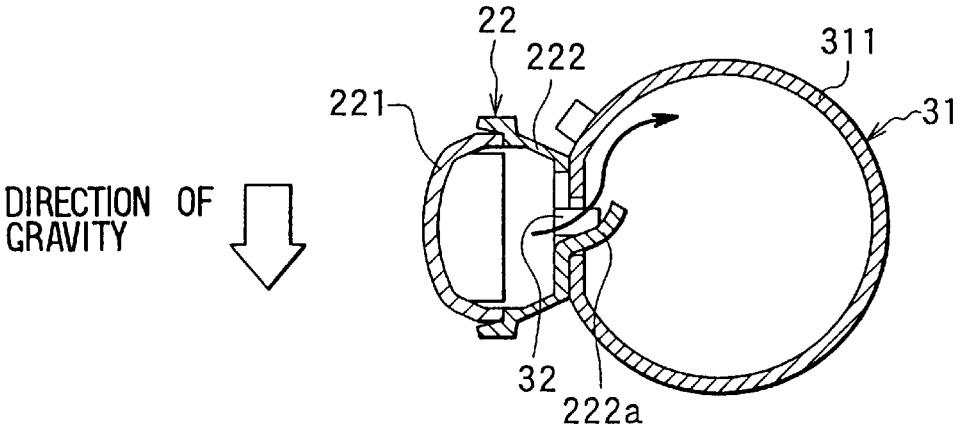
FIG. 8 is a sectional view taken along line VIII—VIII in FIG. 7.

Refrigerant introduced into the separating unit 31 flows at a relatively large speed along the inner wall of the body portion 311 in the circumferential direction, and forms a circular flow in a direction indicated by arrow A in FIGS. 6 and 7 in the separating unit 31. Therefore, centrifugal force is applied to the circular flow of refrigerant. As a result, liquid refrigerant having a relatively large density is collected onto a surface of the inner wall of the body portion 311, and gas refrigerant having a relatively small density is collected toward a center of the body portion 311 due to the centrifugal force. Further, liquid refrigerant on the surface of the inner wall of the body portion 311 is collected into a lower portion of the body portion 311 by gravity.

According to the fourth embodiment, separation performance of gas-liquid two-phase refrigerant by the separating unit 31 is improved using not only gravity but also centrifugal force. Further, in the fourth embodiment, liquid refrigerant is collected onto the surface of the inner wall of the body portion 311 and gas refrigerant is collected toward the center of the body portion 311. Therefore, even when the condenser 2 is disposed in a substantially horizontal direction as shown in FIG. 4, the inlet 32 and the outlet 33 do not need to be respectively formed at upper and lower sides of the center line 31*b* of the separating unit 31, but may be both formed on the center line 31*b*. However, in this case, if the inlet 32 and the outlet 33 are respectively formed at upper and lower sides of the center line 31*b* as shown in FIG. 4, separation performance of refrigerant is further improved.

Figure 9:
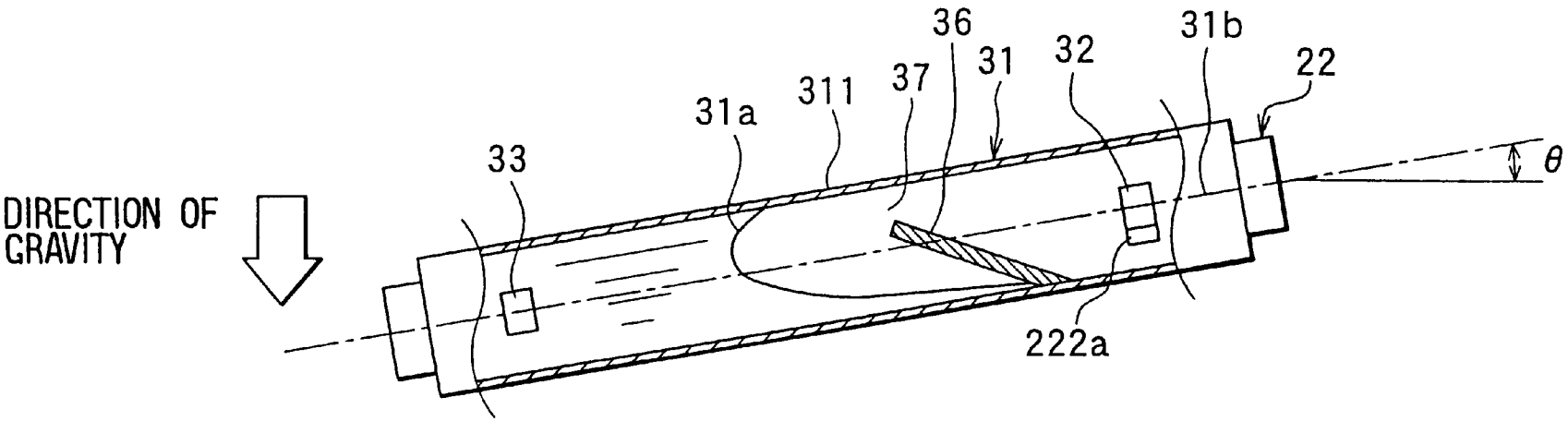
FIG. 9 is a partially-sectional side view showing a separator-integrated condenser for a vehicle air conditioner according to a fifth preferred embodiment of the present invention.

A fifth preferred embodiment of the present invention will be described with reference to FIG. 9. In the fifth embodiment, a separation plate 36 is additionally provided in the condenser 2 of the fourth embodiment. The separation plate 36 is fastened to the inner wall of the body portion 311 of the separating unit 31 between the inlet 32 and the outlet 33, and protrudes from the inner wall of the body portion 311 to extend slantingly toward the outlet 33. A gap 37 is formed between an upper end of the separation plate 36 and the inner wall of the body portion 311. Refrigerant from the inlet 32 flows toward the outlet 33 through the gap 37.

According to the fifth embodiment, a portion below the gap 37 of the separating unit 31 is separated into an inlet-side space disposed at a right side of the separation plate 36 in FIG. 9, and an outlet-side space disposed at a left side of the separation plate 36 in FIG. 9 by the separation plate 36. Therefore, even when a flow rate of refrigerant is relatively small, liquid refrigerant in the outlet-side space is restricted from returning to the inlet-side space by the separation plate 36. As a result, even when the flow rate is relatively small, a level of liquid refrigerant in the outlet-side space in the separating unit 31 maintains relatively high, thereby restricting gas refrigerant from being discharged from the outlet 33. The separation plate 36 may be additionally provided to the first to three embodiments.

The present invention may be applied to the condenser 2 disposed in a substantially horizontal direction in the longitudinal direction of the separating unit 31, and inclined in a direction perpendicular to the longitudinal direction of the separating unit 31. In this case, the second header tank 22 and the separating unit 31 are disposed below the first header tank 21 in the direction of gravity.

Further, in the above-mentioned embodiments, the separating unit 31 may be integrally connected to the first header tank 21, instead of the second header tank 22. Also, the core portion 23 may have only the condensing portion 34, while the supercooling portion 35 is separately formed from the core portion 23 as an independent supercooling unit. In this case, the outlet joint 27 is omitted, and another outlet joint is attached to the separating unit 31, so that liquid refrigerant in the separating unit 31 is discharged from the outlet joint and flows into the supercooling unit through a pipe. Furthermore, the present invention may be applied to a condenser without the supercooling portion 35.

Although the present invention has been fully described in connection with preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A separator-integrated condenser for a refrigeration cycle comprising:

a condensing unit having a core portion for condensing refrigerant, and a header tank into which the refrigerant condensed by the core portion is collected; and a separating unit integrally formed with the header tank so that a longitudinal direction of the separating unit coincides with a longitudinal direction of the header tank, for separating the refrigerant into gas refrigerant and liquid refrigerant, the separating unit including an inlet through which the refrigerant in the header tank is introduced into the separating unit, and an outlet through which the refrigerant is discharged from the separating unit, the inlet being formed at a first longitudinal end of the separating unit, the outlet being formed at a second longitudinal end of the separating unit, wherein the header tank and the separating unit are inclined at a predetermined angle with respect to a horizontal direction in the longitudinal directions thereof, so that the first longitudinal end of the separating unit is disposed at an upper side of the second longitudinal end of the separating unit;

the separating unit has therein a partition plate that is disposed between the inlet and the outlet to partition an inner space of the separating unit into first and second spaces in the longitudinal direction while defining a predetermined gap through which the first and second spaces communicate with each other.

2. The separator-integrated condenser according to claim 1, wherein the predetermined angle is approximately 45 degrees and lower.

3. The separator-integrated condenser according to claim 1, wherein the refrigerant is discharged from a compressor of the refrigeration cycle and flows into the core portion.

4. The separator-integrated condenser according to claim 1, wherein:

the separating unit is formed into a substantially cylindrical shape; and the inlet is formed to cause the refrigerant to flow along an inner wall of the separating unit in a circumferential direction of the separating unit, so that a centrifugal force is applied to a flow of the refrigerant in the separating unit.

5. The separator-integrated condenser according to claim 4, wherein the inlet is formed so that the refrigerant from the inlet flows upwardly along the inner wall of the separating unit.

6. The separator-integrated condenser according to claim 4, further comprising a guiding portion formed adjacent to the inlet for guiding the refrigerant to flow in the circumferential direction of the separating unit along the inner wall of the separating unit.

7. The separator-integrated condenser according to claim 6, wherein the guiding portion protrudes from below the inlet and extends upwardly along the inlet in the separating unit.

8. The separator-integrated condenser according to claim 6, wherein the guiding portion is integrally formed with the header tank.

9. The separator-integrated condenser according to claim 1, wherein:

the refrigeration cycle includes, a compressor for compressing the refrigerant, a decompressor for decompressing the liquid refrigerant discharged from the separating unit, and an evaporator for evaporating gas-liquid two-phase refrigerant decompressed by the decompressor; and the refrigerant discharged from the compressor flows into the core portion.

10. The separator-integrated condenser according to claim 1, wherein an inner diameter of the separating unit is approximately 30 mm.

11. The separator-integrated condenser according to claim 1, wherein the partition plate extends from an inner bottom surface of the separating unit upwardly to form the gap between an inner top surface of the separating unit and a top end of the partition plate.

12. A separator-integrated condenser for a refrigeration cycle comprising:

a condensing unit having, a core portion for condensing refrigerant, and a header tank into which the refrigerant condensed by the core portion is collected; and a separating unit integrally formed with the header tank so that a longitudinal direction of the separating unit coincides with a longitudinal direction of the header tank, for separating the refrigerant into gas refrigerant and liquid refrigerant, the separating unit including an inlet through which the refrigerant in the header tank is introduced thereto, and an outlet through which the refrigerant is discharged therefrom, the inlet being formed at a first longitudinal end of the separating unit, the outlet being formed at a second longitudinal end of the separating unit at a lower side of the inlet, wherein:

the header tank and the separating unit are disposed substantially horizontally in the longitudinal directions thereof, the separating unit has a horizontal center line extending in the longitudinal direction; and the inlet is provided at a position above the center line, and the outlet is provided at a position below the center line.

13. The separator-integrated condenser according to claim 12, wherein the refrigerant is discharged from a compressor of the refrigeration cycle and flows into the core portion.

14. The separator-integrated condenser according to claim 12, wherein:

the separating unit is formed into a substantially cylindrical shape; and the inlet is formed to cause the refrigerant to flow along an inner wall of the separating unit in a circumferential direction of the separating unit, so that a centrifugal force is applied to a flow of the refrigerant in the separating unit.

15. The separator-integrated condenser according to claim 11, wherein the partition plate is tilted toward the second longitudinal end.

* * * * *